US007331538B2

(12) United States Patent
Menze

(10) Patent No.: US 7,331,538 B2
(45) Date of Patent: Feb. 19, 2008

(54) SAFETY GRATER

(75) Inventor: Dietmar Menze, Nassau (DE)

(73) Assignee: Home-Innovation, Nassau (DE)

( * ) Notice: Subject to any disclaimer, the term of this patent is extended or adjusted under 35 U.S.C. 154(b) by 0 days.

(21) Appl. No.: 10/545,480

(22) PCT Filed: Feb. 13, 2004

(86) PCT No.: PCT/EP2004/001336

§ 371 (c)(1),
(2), (4) Date: Mar. 6, 2006

(87) PCT Pub. No.: WO2004/071720

PCT Pub. Date: Aug. 26, 2004

(65) Prior Publication Data

US 2006/0231652 A1 Oct. 19, 2006

(30) Foreign Application Priority Data

Feb. 14, 2003 (DE) ..... 103 05 969

(51) Int. Cl.
*B02C 23/04* (2006.01)

(52) U.S. Cl. ..... 241/37.5; 83/856; 241/95; 241/273.1

(58) Field of Classification Search ..... 241/37.5, 241/95, 273.1–273.4; 83/856, 858, 85; 30/278, 30/279.2; 99/537
See application file for complete search history.

(56) References Cited

U.S. PATENT DOCUMENTS

| | | | | |
|---|---|---|---|---|
| 2,991,814 | A * | 7/1961 | Popeil | 83/105 |
| 4,212,431 | A * | 7/1980 | Doyel | 241/100 |
| 5,745,999 | A | 5/1998 | Zirkiev | |
| 5,765,472 | A | 6/1998 | Kim | |
| 2006/0261196 | A1* | 11/2006 | Klotz et al. | 241/95 |

FOREIGN PATENT DOCUMENTS

| | | |
|---|---|---|
| DE | 486 721 | 11/1929 |
| DE | 865 517 | 7/1949 |
| DE | 296 23 430 U1 | 4/1998 |
| DE | 198 27 077 A1 | 12/1999 |
| EP | 1 264 669 A1 | 12/2002 |
| GB | 342456 | 12/1929 |
| WO | 99/43246 | 9/1999 |
| WO | 02/36312 A1 | 5/2002 |

* cited by examiner

*Primary Examiner*—Mark Rosenbaum
(74) *Attorney, Agent, or Firm*—Pauley Peterson & Erickson

(57) ABSTRACT

A safety grater having a parallelepipedal base body, an attachment that slides back and forth along guide rails by slide bars and that has a cylinder, into which items to be grated and sliced and a plunger are introduced and having at least one grating insert that can be fitted into the base body. The base body has elements that prevent the use of the grating and slicing insert without the attachment.

9 Claims, 5 Drawing Sheets

SAFETY GRATER

BACKGROUND OF THE INVENTION

1. Field of the Invention

This invention relates to a safety grater and slicer.

2. Discussion of Related Art

The kitchen graters and slicers currently available in the market can cause injury to the user by cutting and/or slicing the user's fingers. Even the slicers and graters that include so-called protective "rest holders" are insufficient to guard against serious injury because the user can disregard the safety instructions and slice and grate food without the protective rest holder. A slicer and grater is taught by German Patent Reference DE U1-296-23-430. Every injury can be a potential lawsuit.

SUMMARY OF THE INVENTION

The safety grater and slicer of this invention can eliminate the possibility of injury and thus legal action against the manufacturer by designing a rest holder called a "safety holder" with two major safety advantages.

The safety grater and slicer of this invention includes a safety holder that covers the blades while in use, thus fully protecting the user's fingers.

The safety grater and slicer of this invention will not work without the safety holder in place.

The user must attach the safety holder before the cutting blades can be inserted into the safety grater and slicer of this invention. It is impossible to insert the blades/graters without the safety holder in place. Conversely, after completing the slicing and grating task, the user must remove the blades/graters before the safety holder can be removed. It is impossible to remove the safety holder unless the blades/graters are removed first.

BRIEF DESCRIPTION OF THE DRAWINGS

This invention is explained by the following diagrams.

DESCRIPTION OF PREFERRED EMBODIMENTS

Figure 1:
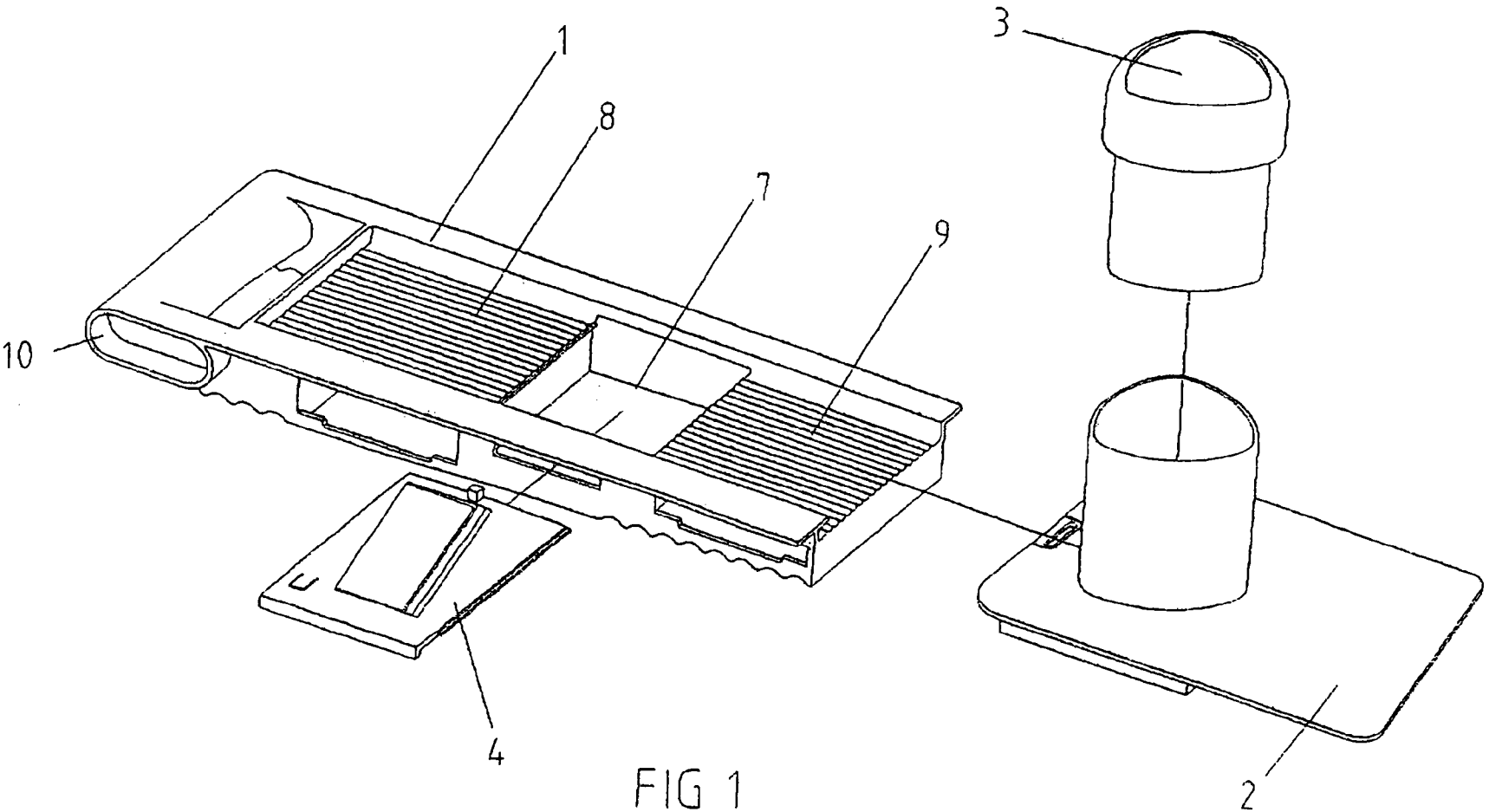
FIG. 1 shows a top exploded perspective view of a cross section explosion diagram of one embodiment of a safety grater and slicer according to this invention.
Figure 2:
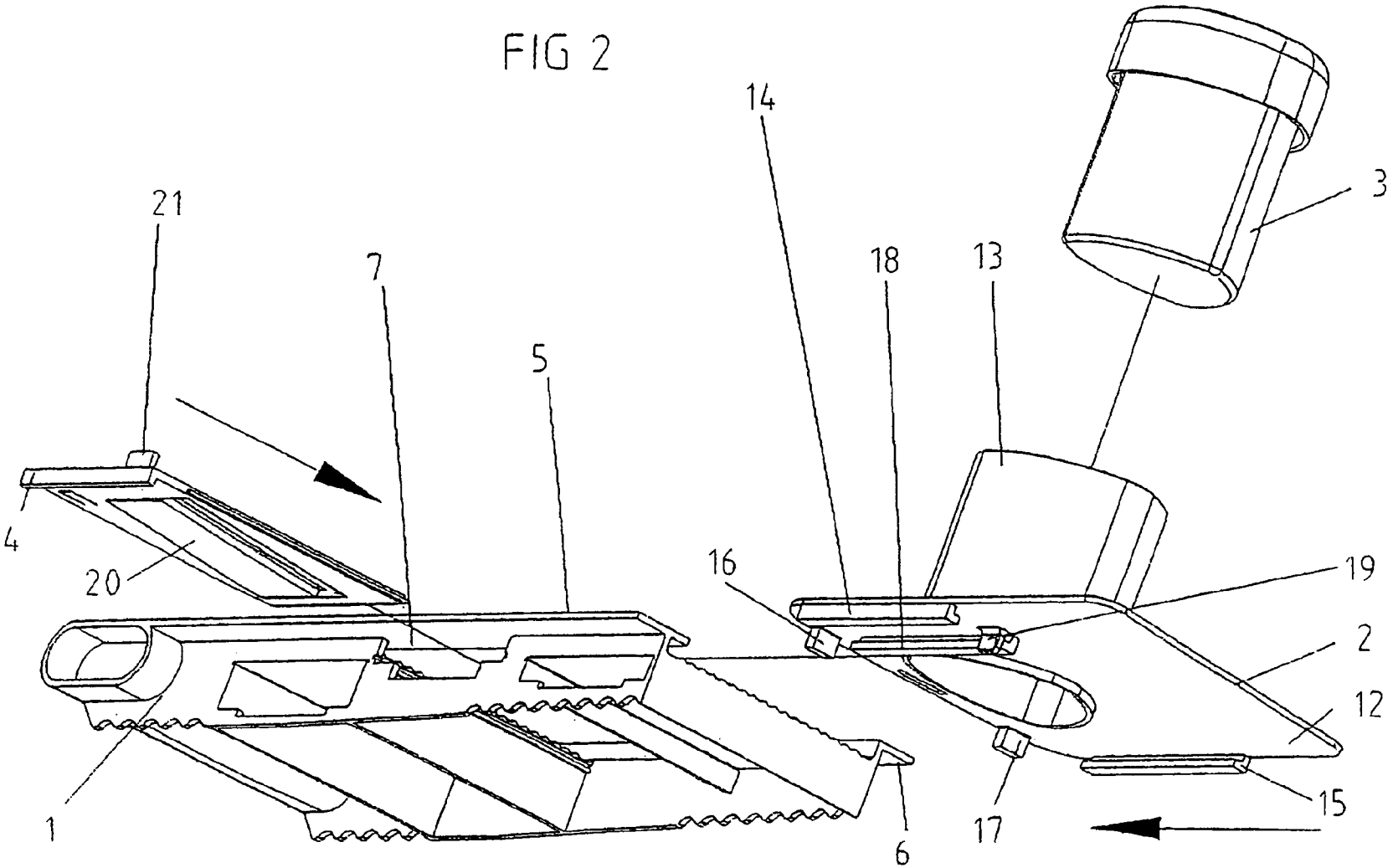
FIG. 2 shows a bottom exploded perspective view of a cross section explosion diagram of one embodiment of a safety grater and slicer according to this invention.
Figure 3:
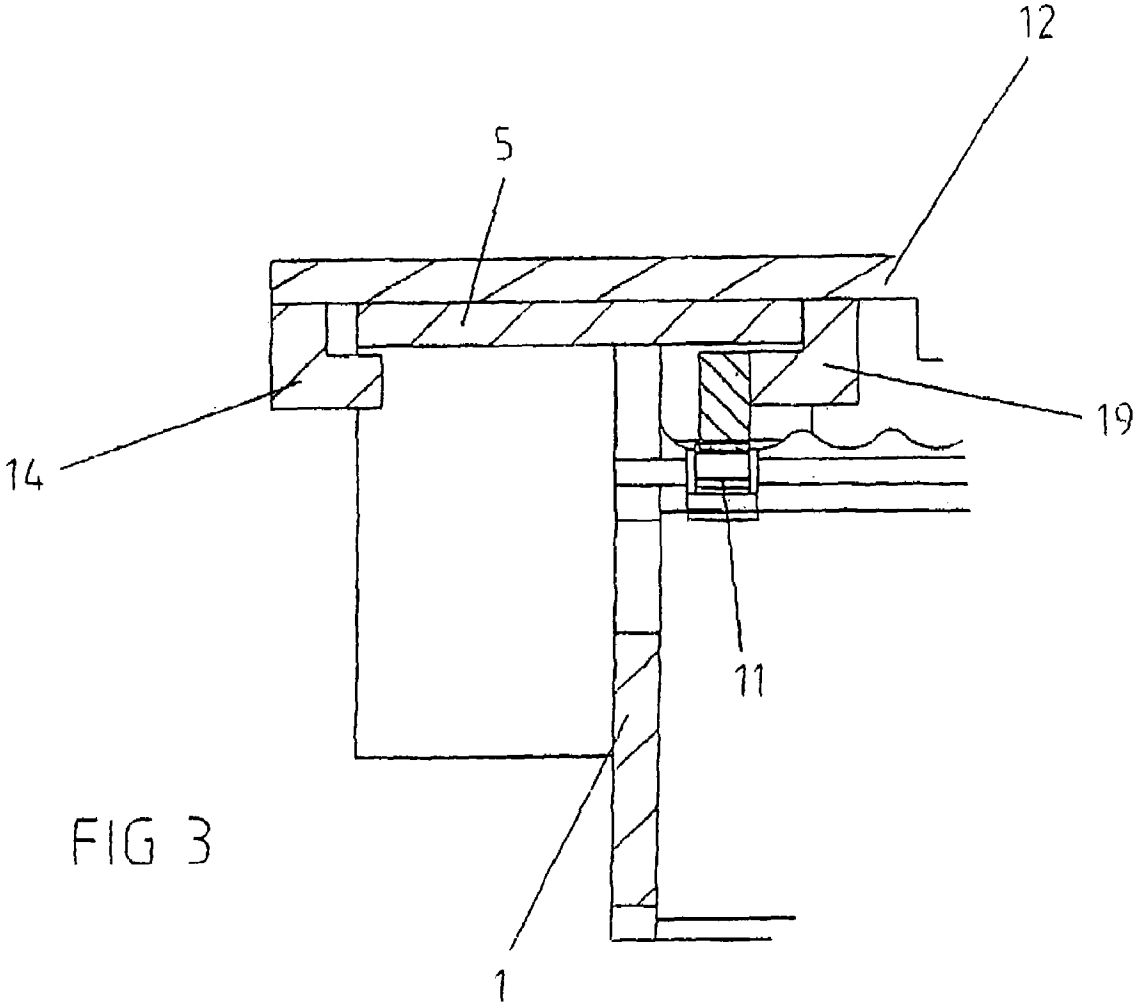
FIG. 3 shows a sectional view of the views shown in FIGS. 1 and 2.

The safety grater and slicer of this invention is shown in FIGS. 1-3 and comprises a squared body (1), a safety holder (2) sliding in the body (1), a stamp (3) which will be picked up by the safety holder (2) and blade/grater inserts (4) which will be put in the body (1) of the safety grater and slicer of this invention.

The body (1) has two rails (5) and (6) at the sides, on which the safety holder (2) can slide. The first rail (5) is T-shaped and the opposite rail (6) is L-shaped. Furthermore, the body (1) has an opening (7) at the side where the user places the blade inserts (4). Between the rails (5) and (6) there are two waved surfaces (8) and (9) split by the opening (7) where the blade inserts (4) fit. The food slides along the waved surfaces (8) and (9) during use. At the end of the body (4) there is a thumb grip (10) to hold the body down on the kitchen counter or other work surface. Finally, there is a moveable block element (11) in the body (1) shown on FIG. 3. The safety holder itself is designed as a squared plate (12) with a tube (13) for taking in the food and a stamp (3) for pushing the food down into the tube into the insert blades (4). The size of the tube (13) can be designed so that a child's hand can not fit down the tube to reach the insert blade (4). The tube (13) can be designed to be high enough that an adult finger can not reach the insert blade (4). At the longer sides of the plate there are two L-shaped sliding rails (14), (15) which cover the edges of these rails (5) and (6) during use. On the underside of the plate (12) there are two block elements (16) and (17) that control how far the plate (12) will slide.

Finally, the plate (12) has an L-shaped rail (18) under it which is between the tube (12) and the rail (13) which covers the inner edges of the rail (5) and which has a release element (19) at one side of the end. The inserts (4) can be designed with different blades (20) to meet various slicing and grating tasks. The insert (4) has at the opposite side of the leading edge at least one block (21).

To use the safety grater and slicer of this invention the user must put the safety holder (2) into the body (1). In doing so the block element (11) will be in a down position so that the opening (7) is now ready to accept the blade insert (4). The user cannot introduce the blade insert (4) until the safety holder (2) has been attached to the body (1) because without first placing the safety holder (2) onto the body (1) the block element (11) will be in the way of the blade insert (4).

This guarantees that the safety grater and slicer of this invention is usable only if the safety holder (2) has been put in prior to use. After the safety holder (2) has been fit into the body (1) it fully covers the insert blade/grater (4) no matter where it is placed while sliding along the body during use. Thus the insert blade/grater (4) is accessible only through the safety holder (2). Food, like potatoes, carrots and cucumbers etc. can go through the open top of the tube (13) to the insert blade/grater (4). The stamp pushes the food fully down through the tube to ensure complete slicing and grating. The block element (16) at the block (21) prevents removal of the safety holder (2) from the body (1) while the blade insert (4) is in place. This ensures that after the blade insert (4) has been put into the body opening (7) the safety holder (2) cannot be removed preventing exposure of the blade insert (4). Again, the safety grater and slicer of this invention will not work without the safety holder (2) in place.

Figure 4:
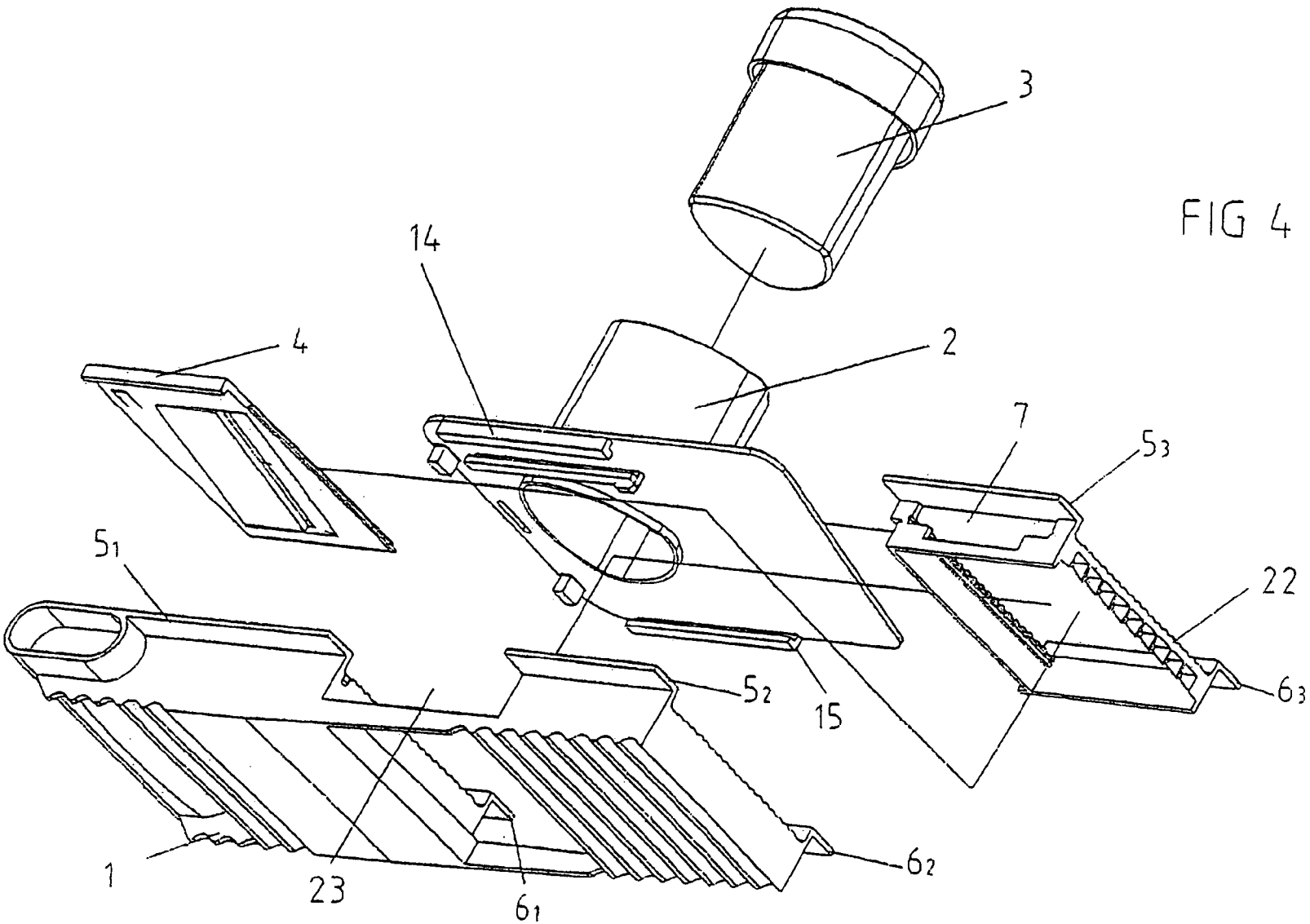
FIG. 4 shows a bottom exploded perspective view of a cross section explosion diagram of one embodiment of a safety grater and slicer according to this invention.

A safety grater and slicer of this invention in a second embodiment is shown in FIG. 4. This version is similar to the safety grater and slicer of this invention of FIG. 1 but is complemented by a separate insert holder (22) which must be attached to the safety holder (2) before use. The body (1) in FIG. 4 also differs from FIGS. 1 and 2 at the side opening (7). The body (1) features an open shaft (23) which splits the side rail into two L-shaped sections, (5/1), (5/2) separated by the open shaft (23). The difference in FIG. 1 is that the side rail (5) is one continuous T-shaped rail.

The insert holder (22) is designed like a box and fits into the body (1) and has two L-shaped rails ($\mathbf{5}_3$, $\mathbf{6}_3$) and an opening at the side in order to take the insert (4). The insert holder (22) fits into the shaft (23). After the putting in the insert holder (22) the rails ($\mathbf{5}_3$, $\mathbf{6}_3$) will line up with the rails ($\mathbf{5}_1$, $\mathbf{5}_2$, $\mathbf{6}_1$, $\mathbf{6}_2$) in the body (1) creating a two seamless rails.

The user slides the insert holder (22) onto the safety holder (2) to create a complete unit that will be placed down into the shaft (23). Only then can the insert blade/grater (4) be introduced into the opening (7) at the side of the body (1). While the insert holder (22) is on the body (1) its underside rails (14) (15) will slide on the rails ($\mathbf{5}_3$, $\mathbf{6}_3$, $\mathbf{6}_1$, $\mathbf{6}_2$) and cover the insert blade/grater (4). When the safety holder (2) is removed from the body (1) the insert holder will not fit into the body (1) making the safety grater and slicer of this invention impossible to use until the safety holder (2) is reattached.

Figure 5:
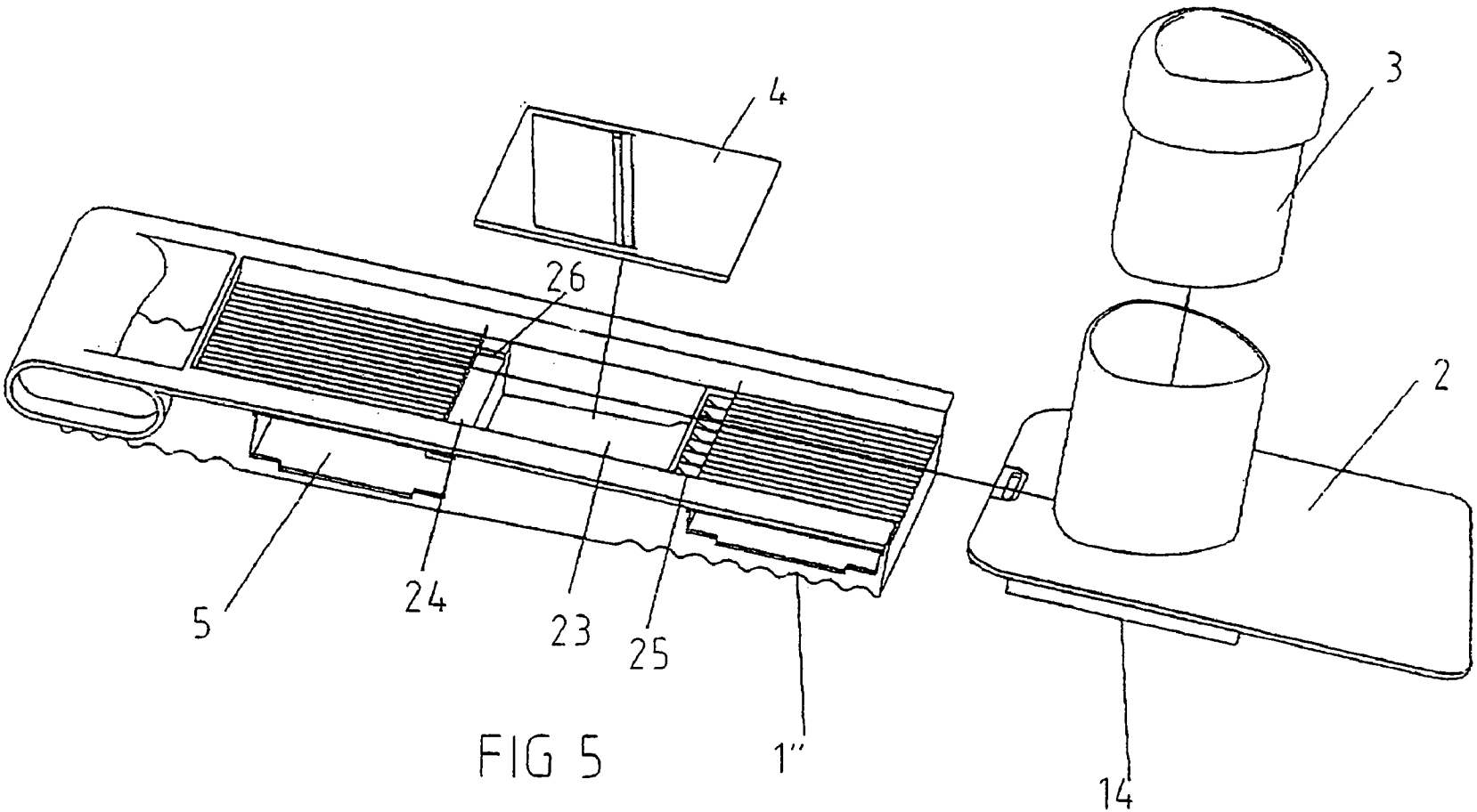
FIG. 5 shows a top exploded perspective view of a cross section diagram of one embodiment of a safety grater and slicer according to this invention.

The safety grater and slicer of this invention in a third embodiment is shown in FIG. 5. This safety grater and slicer of this invention is similar to those shown in FIGS. 1 and 2. The body (1") differs from the body (1) in FIGS. 1 and 2. At the top of the shaft edges there are two rests (24), (25). The rest (24) has a spring element (26) at the end. The blade insert/grater (4) will not fit into the body without the safety holder (2) because the spring element (26) will be in the way and will prevent the safety insert (4) from lying flush inside the body (1). The safety holder (2) must be in place over the blade insert/grater (4) in order to push down the spring element so that the blade is flush with the sliding surface. The safety grater and slicer of this invention will not work unless the safety holder (2) is in place.

The invention claimed is:

1. A safety grater and slicer comprising:

a body with rails, a sliding safety holder with a tube for introducing a food to an insert blade/grater in the body via a stamp for one of grating and slicing, a moveable block element (11), an insert holder (22), and a spring element (26) at the body (1) requiring use of the insert blade/grater (4) with the safety holder (2).

2. The safety grater and slicer according to claim 1 wherein the block element (11) and the spring element (26) are unlocked by the safety holder (2).

3. The safety grater and slicer according to claim 2 wherein a shaft with rests (24, 25) in the body (1) for accepting the insert (4) and the rest (24) has the spring (26) element for the safety holder (2) to hold down the insert (4).

4. The safety grater and slicer according to claim 2 wherein there is an opening (7) at a side of the body (1) to put in the insert (4) and there is the block element (11) in an area of the opening (7).

5. The safety grater and slicer according to claim 4 wherein at an introduction bottom side of the safety holder (2) there is at least one block element (16), (17) and at a back side of the insert (4) there is at least one further block element (21), and the at least one block element (16), (17) and the at least one further block element (21) work together for removing the safety holder (2) out of the body (1) only after the insert (4) has been replaced out of the body (1).

6. The safety grater and slicer according to claim 4 wherein to unlock the block element (11) there is a rail (18) with a release element (19) at an end.

7. The safety grater and slicer according to claim 6 wherein at an introduction bottom side of the safety holder (2) there is at least one block element (16), (17) and at a back side of the insert (4) there is at least one further block element (21), and the at least one block element (16), (17) and the at least one further block element (21) work together for removing the safety holder (2) out of the body (1) only after the insert (4) has been replaced out of the body (1).

8. The safety grater and slicer according to claim 1 wherein on both sides of the body (1) there is an open shaft (23) and the insert holder (22) is positionable in the shaft (23) and accepts the insert (4).

9. The safety grater and slicer according to claim 6 wherein each of the rails of the body (1) are split by the shaft (23) into two rails ($\mathbf{5}_1$, $\mathbf{5}_2$) and ($\mathbf{6}_1$, $\mathbf{6}_2$) and the insert holder (22) has rails ($\mathbf{5}_3$, $\mathbf{5}_4$) aligned with the rails ($\mathbf{5}_1$, $\mathbf{5}_2$) and respectively ($\mathbf{6}_1$, $\mathbf{6}_2$) with the insert holder in the body (1).

* * * * *